US008672583B1

(12) United States Patent
Mailhot et al.

(10) Patent No.: US 8,672,583 B1
(45) Date of Patent: Mar. 18, 2014

(54) CORRUGATED STORMWATER CHAMBER HAVING SUB-CORRUGATIONS

(75) Inventors: David J. Mailhot, Coventry, CT (US); Nimish Gandhi, Wethersfield, CT (US); Timothy J. McGrath, Arlington, MA (US)

(73) Assignee: StormTech LLC, Wethersfield, CT (US)

( * ) Notice: Subject to any disclaimer, the term of this patent is extended or adjusted under 35 U.S.C. 154(b) by 446 days.

(21) Appl. No.: 12/802,483

(22) Filed: Jun. 7, 2010

Related U.S. Application Data

(60) Provisional application No. 61/217,905, filed on Jun. 5, 2009.

(51) Int. Cl.
*E02B 11/00* (2006.01)

(52) U.S. Cl.
USPC ..... 405/46; 405/42; 405/43; 405/49

(58) Field of Classification Search
USPC ..... 405/42, 43, 46, 49, 50, 124, 126; 52/220.4
See application file for complete search history.

(56) References Cited

U.S. PATENT DOCUMENTS

| | | | | |
|---|---|---|---|---|
| 414,767 | A | | 11/1889 | Fox |
| 980,442 | A | | 1/1911 | Schlafly |
| 1,948,619 | A | | 2/1934 | Knutson |
| 1,989,950 | A | | 2/1935 | Snyder |
| 2,259,335 | A | | 10/1941 | Carswell et al. |
| 3,104,681 | A | | 9/1963 | Gray, Jr. |
| 3,111,788 | A | | 11/1963 | Paul |
| 3,151,947 | A | | 10/1964 | Hastings |
| 3,363,799 | A | | 1/1968 | Zurcher et al. |
| 3,427,767 | A | | 2/1969 | Schaefer |
| 3,440,823 | A | | 4/1969 | Olsen et al. |
| 3,559,692 | A | | 2/1971 | Mantelet |
| 3,658,097 | A | | 4/1972 | Martin et al. |
| 3,699,684 | A | | 10/1972 | Sixt |
| 3,789,615 | A | * | 2/1974 | Maroschak ..... 405/49 |
| 3,820,340 | A | | 6/1974 | Jenner et al. |

(Continued)

FOREIGN PATENT DOCUMENTS

| | | |
|---|---|---|
| DE | 1282562 | 11/1968 |
| DE | 10139897 | 2/2003 |

(Continued)

OTHER PUBLICATIONS

James L. Beaver et al., *Structure Design of Stormwater Chambers*, Trasportation Research Board Annual Meeting, 22 pages (2003).

(Continued)

*Primary Examiner* — Benjamin Fiorello
(74) *Attorney, Agent, or Firm* — Finnegan, Henderson, Farabow, Garrett & Dunner, L.L.P.

(57) ABSTRACT

A plastic arch-shape cross section corrugated stormwater chamber has a multiplicity of crest corrugations and valley corrugations which run transverse to its length. Sub-corrugations run along part or all of the arch-curve lengths of either crest corrugations or valley corrugations, or along both of them. A sub-corrugations are smaller in dimension than an associated crest corrugation or valley corrugation. Sub-corrugations may taper in width and depth and may taper to nothingness. A compound convex shape end cap, useful for closing off the ends of stormwater chambers, has substantially vertical corrugations with analogous sub-corrugations.

21 Claims, 7 Drawing Sheets

(56) References Cited

U.S. PATENT DOCUMENTS

| | | | | | |
|---|---|---|---|---|---|
| 3,855,799 | A | | 12/1974 | Martin et al. | |
| 3,863,415 | A | | 2/1975 | Bott | |
| 3,958,425 | A | | 5/1976 | Maroschak | |
| 4,006,599 | A | | 2/1977 | Hegler et al. | |
| 4,113,818 | A | | 9/1978 | Drossbach | |
| 4,140,422 | A | | 2/1979 | Crumpler, Jr. et al. | |
| 4,144,369 | A | | 3/1979 | Wass | |
| 4,322,179 | A | | 3/1982 | Lamphier et al. | |
| 4,359,167 | A | | 11/1982 | Fouss et al. | |
| 4,360,042 | A | * | 11/1982 | Fouss et al. | 138/119 |
| 4,382,435 | A | | 5/1983 | Brill-Edwards | |
| 4,451,172 | A | | 5/1984 | Lamphier et al. | |
| 4,487,232 | A | | 12/1984 | Kanao | |
| 4,490,072 | A | | 12/1984 | Glasser | |
| 4,523,613 | A | * | 6/1985 | Fouss et al. | 138/121 |
| 4,523,874 | A | | 6/1985 | Miki et al. | |
| 4,689,261 | A | | 8/1987 | Ahnstrom | |
| 4,690,174 | A | | 9/1987 | Jarvenkyla | |
| 4,776,139 | A | | 10/1988 | Lockwood | |
| 4,862,652 | A | | 9/1989 | Lockwood | |
| 4,865,362 | A | | 9/1989 | Holden | |
| 4,930,936 | A | | 6/1990 | Hegler et al. | |
| 4,932,184 | A | | 6/1990 | Waller | |
| 4,950,103 | A | | 8/1990 | Justice | |
| 4,962,622 | A | * | 10/1990 | Albrecht et al. | 52/630 |
| 5,007,462 | A | | 4/1991 | Kanao | |
| 5,060,444 | A | | 10/1991 | Paquette | |
| 5,071,173 | A | | 12/1991 | Hegler et al. | |
| 5,191,916 | A | | 3/1993 | Kanao | |
| 5,326,191 | A | | 7/1994 | Wilson et al. | |
| 5,336,017 | A | | 8/1994 | Nichols | |
| 5,375,943 | A | * | 12/1994 | McCavour et al. | 405/126 |
| 5,498,104 | A | | 3/1996 | Gray | |
| 5,556,231 | A | | 9/1996 | Sidaway et al. | |
| 5,573,038 | A | | 11/1996 | Kanao | |
| 5,707,088 | A | | 1/1998 | Miller et al. | |
| 5,716,163 | A | | 2/1998 | Nichols et al. | |
| 5,720,577 | A | | 2/1998 | Sanders et al. | |
| 6,079,451 | A | | 6/2000 | Hegler | |
| 6,126,209 | A | | 10/2000 | Goddard | |
| 6,129,482 | A | | 10/2000 | Di Tullio | |
| 6,131,616 | A | | 10/2000 | Tatsuta et al. | |
| 6,270,287 | B1 | | 8/2001 | Gray | |
| 6,322,288 | B1 | | 11/2001 | Di Tullio | |
| 6,644,357 | B2 | | 11/2003 | Goddard | |
| 6,698,975 | B1 | | 3/2004 | Benecke | |
| 6,719,490 | B2 | | 4/2004 | Maestro | |
| 6,773,206 | B2 | | 8/2004 | Bradley et al. | |
| D498,815 | S | | 11/2004 | Greer | |
| 6,860,518 | B2 | | 3/2005 | Krauss et al. | |
| 6,941,972 | B2 | | 9/2005 | Toliver | |
| 7,025,532 | B2 | | 4/2006 | Suazo et al. | |
| 7,144,506 | B2 | | 12/2006 | Lombardi, II | |
| 7,147,007 | B2 | | 12/2006 | Renaud | |
| 7,156,580 | B2 | | 1/2007 | Suazo et al. | |
| 7,165,914 | B2 | | 1/2007 | Suazo | |
| 7,306,264 | B2 | | 12/2007 | Goddard et al. | |
| 7,306,399 | B1 | | 12/2007 | Smith | |
| 7,314,066 | B2 | | 1/2008 | Castillo et al. | |
| D566,852 | S | | 4/2008 | Gaster et al. | |
| 7,357,600 | B2 | | 4/2008 | Suazo et al. | |
| 7,451,784 | B2 | | 11/2008 | Goddard | |
| 7,470,085 | B1 | | 12/2008 | Suazo | |
| 7,484,535 | B2 | | 2/2009 | Goddard et al. | |
| 7,517,172 | B2 | | 4/2009 | Sipaila | |
| 7,611,306 | B1 | | 11/2009 | Hallahan et al. | |
| 7,628,566 | B2 | | 12/2009 | Miskovich | |
| 7,637,691 | B1 | | 12/2009 | DiTullio | |
| 7,707,786 | B2 | | 5/2010 | Theophilus | |
| 7,758,282 | B2 | | 7/2010 | Suazo | |
| 7,870,700 | B2 | | 1/2011 | Arguelles | |
| 7,914,231 | B2 | | 3/2011 | Coppes et al. | |
| 2002/0025226 | A1 | | 2/2002 | Maestro | |
| 2003/0095838 | A1 | | 5/2003 | Maestro | |
| 2005/0111915 | A1 | * | 5/2005 | Moore et al. | 405/46 |
| 2006/0162799 | A1 | | 7/2006 | Goddard | |
| 2006/0289075 | A1 | | 12/2006 | Diez | |
| 2008/0240859 | A1 | * | 10/2008 | Sipaila | 405/46 |
| 2009/0067929 | A1 | * | 3/2009 | Brochu et al. | 405/49 |
| 2009/0117302 | A1 | | 5/2009 | Kanao | |
| 2009/0127853 | A1 | | 5/2009 | Sutton et al. | |
| 2009/0220302 | A1 | | 9/2009 | Cobb et al. | |
| 2009/0232600 | A1 | | 9/2009 | Kim et al. | |
| 2009/0295153 | A1 | | 12/2009 | Knapp | |
| 2010/0059430 | A1 | | 3/2010 | Adams et al. | |
| 2010/0126616 | A1 | | 5/2010 | Kanao | |
| 2011/0150574 | A1 | | 6/2011 | Semotiuk | |
| 2011/0200391 | A1 | * | 8/2011 | Mailhot et al. | 405/42 |

FOREIGN PATENT DOCUMENTS

| | | |
|---|---|---|
| DE | 202005005056 | 2/2005 |
| EP | 1122481 | 8/2001 |
| GB | 2016639 | 9/1979 |
| JP | 09235828 | 9/1997 |
| JP | 2002294849 | 10/2002 |
| JP | 2002294850 | 10/2002 |
| JP | 2002302995 | 10/2002 |
| JP | 2003176564 | 6/2003 |
| JP | 2003176565 | 6/2003 |
| JP | 2005042538 | 2/2005 |
| JP | 2005213854 | 8/2005 |
| WO | WO 2004061249 | 7/2004 |
| WO | WO 2007/021715 | 2/2007 |
| WO | WO 2007/138780 | 12/2007 |
| WO | WO 2009102855 | 8/2009 |

OTHER PUBLICATIONS

Infiltrator Systems, Inc. Equalizer 36 Chambers Product Brochure , 4 pages (2004).

* cited by examiner

CORRUGATED STORMWATER CHAMBER HAVING SUB-CORRUGATIONS

This application claims benefit of Provisional Patent Application No. 61/217,905 filed Jun. 5, 2009.

TECHNICAL FIELD

The present invention relates to systems for receiving and dispersing water beneath the surface of the earth, in particular to molded plastic chambers having arch shape cross section and corrugations.

BACKGROUND

Arch shape cross section commercial thermoplastic storm chambers are familiar in commerce. They have been made by injection molding and thermoforming. Before more tailored products were developed, wastewater leaching chambers had been used as storm chambers. Typically, an interconnected array of chambers is buried within permeable soil to create large void spaces. Stormwater, such as results from rainfall on a paved parking lot, is flowed to the chambers. The water is detained, and over time either controllably flowed to a discharge point, and or allowed to dissipate through the earth.

A type of chamber relevant to the present invention has a curved arch shape cross section and spaced apart crest corrugations and valley corrugations running transverse to the length. (Crest corrugations have been referred to as peak corrugations in numerous patents relating to chambers.) The corrugations strengthen the chamber and are differentiated from what is called ribs or ribbing, which is the name given to relatively narrow plastic structures, also used for strengthening, and often found running lengthwise. See U.S. Pat. No. 5,716,163 of Nichols et al. for information about ribbing.

Prior art commercial storm chambers have had various sizes. Smaller chambers have been about 3 feet wide and 8-10 feet long. The SC-310 chamber and SC-740 chamber of Stormtech LLC, Wethersfield, Conn., exemplify current chambers. As an example, the SC-740 chamber is about 85 inches long, 51 inches wide and 30 inches high, and weighs about 74 pounds.

There has been market place opportunity for larger dimension chambers in the belief they would provide more favorable cost per unit volume of water contained within the chamber, and a smaller footprint for a given capacity stormwater system. Any new large chamber desirably will not have such weight as to prevent installers from handling it manually during installation. It is essential that a new chamber be sufficiently strong, in resisting the weight of overlying soil (typically largely crushed stone), any pavement surfacing and any motor vehicles or the like which traverse the pavement.

Buried corrugated plastic pipe has been used for a longer time than storm chambers and there is a developed technology for engineering design and analysis of such. See Section 12.12 "Thermoplastic Pipes" in "AASHTO LRFD Bridge Design Specifications—U.S. Units, 2003 Interim Revisions," published by Amer. Assoc. of State Highway and Transportation Officials (AASHTO), Washington, D.C., Code LRFDUS 2-15 (April 2003). See also NCHRP Report 438 "Recommended LRFD Specification for Plastic Pipe and Culverts" published by Transportation Research Board of National Research Council, National Academy Press, Washington, D.C. (2000). However, whereas pipes have circumferentially continuous cross sections, chambers have open bottoms and free opposing side bases. Thus, chambers behave differently and the specifications, design criteria and modes of evaluating behavior which have been developed for pipe have to be adapted to chambers. An objective of the present invention is to provide large stormwater chambers which have performance and safety factors consistent with those achieved with corrugated plastic pipe.

Another criterion that is important for old and new chambers relates to economical shipping and storage. For that, chambers must nest well one within the other. Thus, for example, a desire for certain strengthening features, such as ribs or such as corrugations which are closely spaced with steep sides, can conflict with the need for good nesting.

As is well known, engineers have to be careful when scaling up the size of products, since what previously might have been minor design factors can become critical factors. Obviously, if chamber width is increased, more overlying weight is supported by the chamber, and strength must be sufficient. One way of increasing strength in a chamber is to increase the thickness of the chamber sidewalls, sufficient to reduce stress so it is within design criteria. But doing that has substantial disadvantages, as follows.

Commercially feasible chambers have to be fabricable by economic mass production means. Injection molding is the only practical way to fabricate a chamber with carefully controlled thickness dimensions. However, if an injected molded chamber is made with substantially varying wall thickness, problems arise with respect to mold filling and distortion of the part during cooling after removal from the mold. Thus, experience has shown that a practically-manufactured chamber should have substantially uniform wall thickness. But if wall thickness is uniformly increased to provide sufficient capability to the strength-limited regions of the chamber, the resultant chamber may have an undesirably increased weight and attendant material cost. Furthermore, the injection capacity limits of commercially available injection molding machines may be reached, limiting choice of vendors or making injection molding impossible. Thermoforming is an alternative way for forming chambers, but the nature of the process is such that unwanted thin areas will be present in the product, due to the stretching of the sheet being formed into the chamber. That can mean that, in order to achieve a minimum required dimension at a particular point, a larger than needed thickness has to be accepted in other less-stretched areas, with resultant uneconomic use of material.

In the alternative, internal or external ribbing can provide good strength. However, such ribbing tends to increase the stacking height, that is, the vertical spacing between two nested chambers. Ribbing can also introduce molding problems. In recent years, commercial favor has been given to stormwater and leaching chamber designs have smooth curve cross sections and which avoid significant ribbing.

Thus, there can be complicated tradeoffs in the design of a chamber, necessary to best attain all the competing aims. Any new larger chamber must be economical to make in terms of the amount and cost of plastic, the cost of manufacturing, and cost of shipping. In such context, there is a need for chambers which are larger than heretofore, which are practically fabricated, transported, and stored, and which in use have good strength on a short term and long term basis. Chambers are typically interconnected as strings. The ends of the strings must be closed off by end caps to prevent the surrounding crushed stone aggregate or other medium from entering the concave space under the chamber. Heretofore caps used with storm chambers and with leaching chambers have comprised flat plate and dome shape closures, typically with heavy ribbing. There is a need for improvements in end caps in the same general way as there is need for improved chambers.

SUMMARY

An object of the invention is to provide strength to molded plastic continuous curve arch shape cross section chambers, in particular stormwater chambers having large dimensions. A further object is to improve the strength without using features which compromise the injection moldability of a chamber. Another objective is to provide chambers which perform comparably to corrugated plastic pipe, in accord with the aforementioned AASHTO related specifications.

In accord with the invention, a chamber has an arch shape cross section and corrugations comprised of alternating crests and valleys which run along the arch curve of the chamber, transverse to the length of the chamber and across the arch-curve of the chamber. Corrugations run from one opposing side base, up over the top of the chamber and down to the other opposing side base of the chamber. With increasing elevation, the crest corrugations diminish in width, and the valley corrugations increase in width.

In embodiments of the invention, either or both of the crest corrugations and valley corrugations have sub-corrugations. That is, there are smaller or secondary corrugations which are superimposed on the corrugations. Sub-corrugations may run along part or all of the arch-curve length of a corrugation. Exemplary sub-corrugations have widths which are substantially less than the widths of the associated corrugations, for instance, the sub-corrugation width is one-third of the local width of the associated corrugation. A sub-corrugation may desirably have a tapered width along part or all of the sub-corrugation length, and the taper or change in width and or depth is in the same sense as the width of the associated corrugation. Alternately, sub-corrugations may have constant width.

In some embodiments, sub-corrugations run upwardly from the base of the chamber along the crest corrugations and terminate at an elevation which is lower than the height of the top of the chamber. For instance, they may terminate at a height which is between one-quarter and two-thirds of the chamber height. Sub-corrugations may terminate by dying out, that is, the width and or depth of the corrugation may decrease gradually to nothingness at the terminal end of the sub-corrugations. Alternately, the terminal ends may be abrupt.

In other embodiments, a chamber may have sub-corrugations in the valley corrugations, with or without the presence of crest sub-corrugations. Valley sub-corrugations may run over the top of the chamber and downwardly toward the opposing side bases. In some embodiments, the valley sub-corrugations terminate, by ending bluntly or tapering into nothingness, at or just above the elevation of the base of the chamber; alternately, at a higher elevation.

In other embodiments, there are both crest and valley sub-corrugations, and the terminal lower ends of the valley sub-corrugations are at an elevation which is less than the elevation at which are the terminal ends of the upward-running crest sub-corrugations. In still other embodiments, the terminal ends of sub-corrugations may terminate abruptly, rather than tapering to nothing.

The presence of the sub-corrugations improves to a surprising degree the strength of a chamber side wall. The load bearing capacity per unit length of side wall, and thus the capacity of the chamber to resist failure, is increased by as much as 45 percent compared to the same wall thickness corrugated chamber having no sub-corrugations. Yet the weight increase attributable to the sub-corrugations may be as a little as one percent.

Thus, a chamber of the present invention having sub-corrugations may have good strength without the disadvantages of having wholly greater chamber wall thickness, or of having selectively thickened walls, or having ribbing, which alternatives diminish in varying extents manufacturability, nesting and cost effectiveness. The invention may be applied to chambers made of thermoplastics such a polypropylene or polyethylene, which are injection molded. rotationally molded, thermoformed, laid up, or made by any commercial plastic forming process.

The foregoing and other objects, and the features and advantages of the present invention will become more apparent from the following description of preferred embodiments and accompanying drawings. This summary states in simplified form things which are described more fully in the Description which follows, and it is not intended to identify all key features of the invention, or to be a limitation on the scope of the claimed subject matter.

DESCRIPTION

Figure 1:
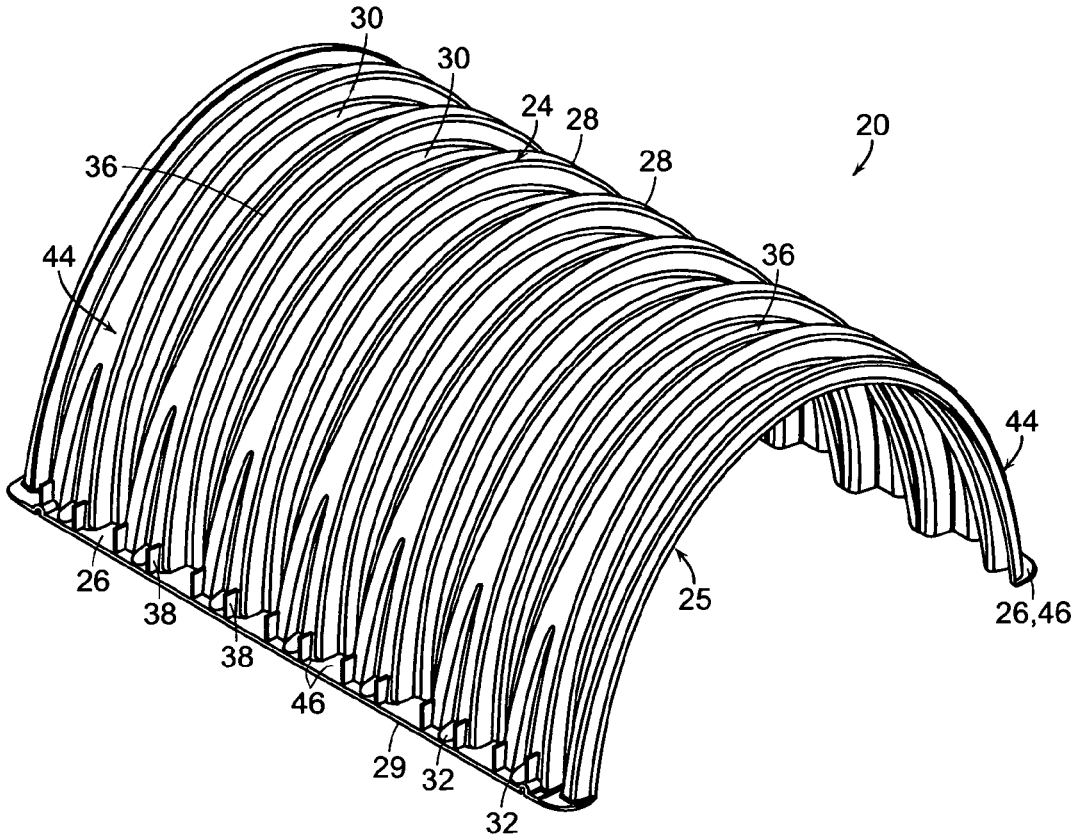
FIG. 1 is perspective view of a stormwater chamber having crest and valley corrugations with associated sub-corrugations.
Figure 2:
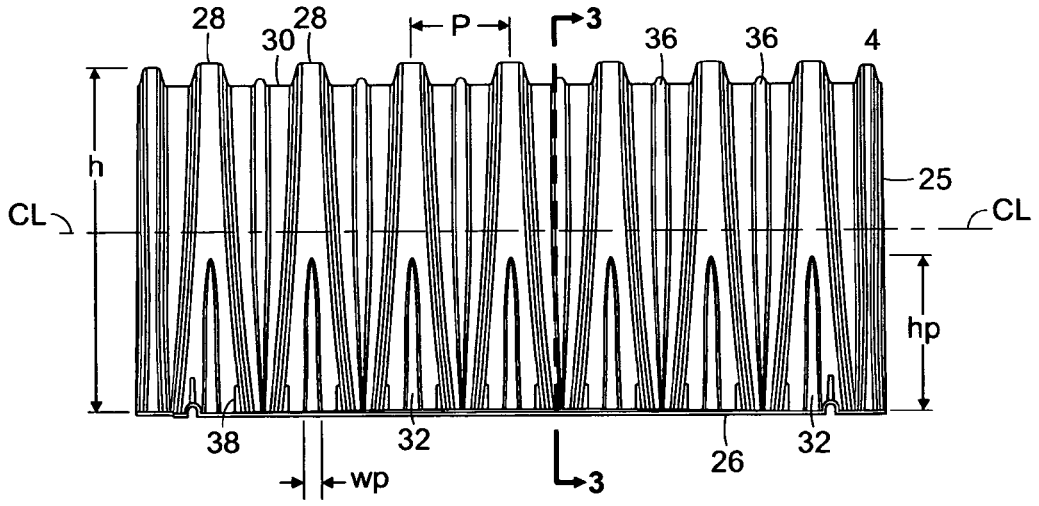
FIG. 2 a side elevation view of a portion of the chamber shown in FIG. 1.
Figure 3:
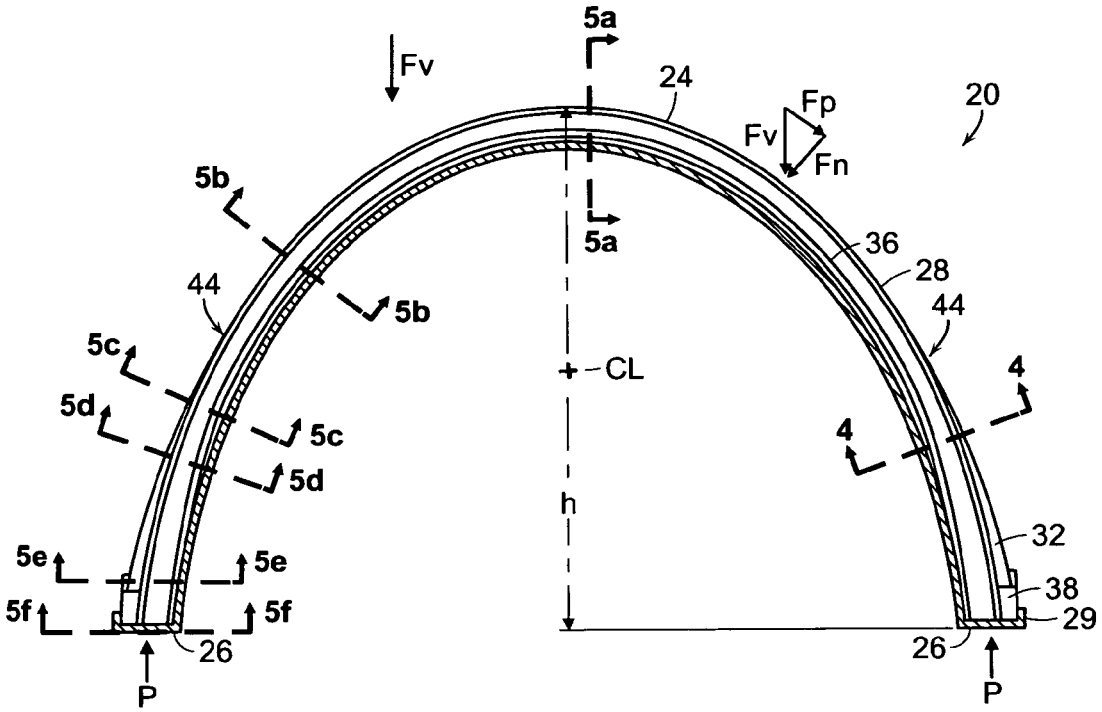
FIG. 3 is a vertical plane transverse cross section of the chamber shown in FIG. 1.

An embodiment of stormwater chamber 20, shown in FIGS. 1, 2 and 3, has a curved arch shape cross section. The opposing side walls 44 rise upwardly from opposing side bases 26 and curve inwardly to top 24. The opposing side bases 26 comprise horizontal flanges 46 which provide bearing area upon the soil upon which the chamber rests. The base of a chamber is sometimes referred to as the foot. In the chamber embodiments which are detailed below, the arch curve of the chamber cross section is smooth and continuously curving. Chambers within the invention may have other arch shape cross sections. For example, the arch curve may comprise interconnected flat portions; or the cross section may be nominally trapezoidal, as shown for instance in U.S. Pats. No. 5,017,041 and 5,511,903. Thus, the term "arch curve" and analogous verbiage of the description and claims which follows shall encompass the contour of the chamber arch as seen in a chamber end view, regardless the shape is not truly a curve.

Chambers of the present invention may have cross sections which preferably are truncated semi-ellipses as described in U.S. Pat. No. 7,052,209 of Kruger et al. Alternately, the cross section may have the shape of a parabola, a truncated semi-circle, or approximations those and other regular geometric shapes, as well as irregular and asymmetrical shapes.

For strength chamber 20 has alternating crest corrugations 28 and valley corrugations 30 which run over the arc shape cross section. More information about the design and shape and use of corrugated chambers of the present invention is disclosed in U.S. Pat. No. 7,052,209 and U.S. Pat. No. 7,118,306 both of Kruger et al., the disclosures of which are hereby incorporated by reference. The disclosure of provisional patent application No. 61/217,905 filed Jun. 5, 2009, from which this application claims benefit, is also hereby incorporated by reference.

Stormwater chambers are typically buried within crushed stone aggregate or other water permeable granular medium that typically has 20-40 percent or more void space. The medium which overlies, underlies or surrounds a chamber may vary in character according to its location, and according to the material which extends to the surface of the earth. The medium within which a chamber is buried during use is generally referred to here as soil. That term should be understood to comprehend the commonly used crushed stone aggregate, as well as other manufactured media.

A simple description of some of the complex load-related phenomena associated with a chamber buried in soil is as follows: With reference to the transverse cross section of chamber 20 shown in FIG. 3, there is a vertical unit area load Fv, as a result of the weight of overlying soil and any transient load (e.g., a motor vehicles). The load is applied to the upper surface of the chamber by the soil which is in contact with the chamber. There is a resultant upward reaction force P at the opposing side bases 26 of the chamber, according to the total downward force on the chamber. The applied vertical load creates in the curved chamber sidewalls 44 compressive stresses Fp and shear stresses Fn. The compressive stress direction in a stable chamber is nominally in a direction which is tangent to the local mean curve of the chamber wall. The shear stresses are nominally perpendicular to the local mean curve of the wall. The soil load also creates bending stresses in the chamber sidewall. The stresses in the chamber wall vary with elevation from the chamber base. For example, compressive stress increases with proximity to the base.

When the load bearing capacity of a chamber is exceeded, the chamber sidewall can fail on a short term or long term basis. Typically, failure occurs when the chamber wall is crushed under soil load. Prior to failure by wall crushing, elements of the corrugation wall may buckle in a local manner thus reducing the load capacity of the buckled elements and causing the stable elements of the corrugation to be more highly stressed. As mentioned in the Background, stresses can be reduced, and the strength and stability of a chamber can be increased, by increasing wall thickness. But that is undesirable; and the invention provides an effective alternative way of strengthening the chamber.

With reference again to FIG. 1 through FIG. 3, an exemplary embodiment chamber 20 has a curved top 24 (also referred to as the crown) and sidewalls 44 which run upwardly to the top from opposing side bases 26. The bases comprise horizontal flange portions 46 bearing on soil during use. Extending upwardly from the base flanges are a multiplicity of spaced apart fins 38, commonly called stacking lugs, the use of which is well known. The lugs 38 support the base flange of an overlying nested chamber, to stop nested chambers from jamming during shipment or storage. Generally, the height of the stacking lugs is chosen so that the corrugations of nested chambers may come very close, or into light contact with each other, without wedging together. See Brochu et al. U.S. Pat. No. 7,500,805 for information about how chambers nest, the disclosure of which is hereby incorporated by reference. An outer fin 29 runs lengthwise along the outer end of each base flange, to add lengthwise bending strength to the flange.

Chamber 20 has a multiplicity of corrugations which run transverse to the chamber length axis CL. The corrugations are comprised of crest corrugations 28 and valley corrugations 30; they are spaced apart along the length axis CL of the chamber with a period (also called pitch) P.

Each corrugation and sub-corrugation (i.e., the corrugations generally) has a width which is measured in a first plane which is parallel to the length axis of the chamber. Each corrugation has a depth which is measured a plane perpendicular to the length axis, typically normal to a tangent to the surface of the chamber/corrugation at the point of measurement. The depth of a corrugation is sometimes also referred to as the height of the corrugation. The length of a corrugation is a reference to the dimension of the corrugation as it runs along the arch-curve of the chamber. For brevity, crest corrugations are sometimes referred to as crests, and valley corrugations are sometimes referred to valleys. In prior patents, crest corrugations have been referred to as peak corrugations.

As seen from FIG. 2, each crest corrugation becomes narrow in width with elevation; and each valley corrugation increases in width with elevation. That shaping facilitates compact nesting. See Brochu et al. U.S. Pat. No. 7,306,399 the disclosure of which is hereby incorporated by reference. The corrugation dimensions and associated sub-corrugation dimensions are selected to provide a desired chamber strength, in context of the properties of the plastic material and the basic wall thickness of the chamber. Basic wall thickness is the nominal thickness of the chamber wall and top, as distinguished for example from possible locally thicker regions involving flow channels, bosses, openings, etc.

In chamber 20 and other embodiments the corrugations may comprise smaller corrugations 36, 32 which run lengthwise of along the corrugations. The smaller corrugations are called here sub-corrugations. In embodiments of the invention, a sub-corrugation has a height which is substantially less than the local height/depth of the corrugation with which the sub-corrugation is associated. Sub-corrugations alternately may be referred to as secondary corrugations or mini-corrugations. Preferably, a sub-corrugation is centered within or on its associated corrugation. Sub-corrugations of the present invention are contours of the wall of the chamber; that is, both the inner and outer surfaces of the chamber are contoured and the wall thickness across the width of the sub-corrugation typically does not change greatly.

Sub-corrugations are distinguished from flow channels that aid injection molding. Flow channels are relatively small thickened bands on the chamber wall that aid the flow of plastic during injection molding. They may project inwardly, outwardly, or both inwardly and outwardly from the wall on which they are positioned. See U.S. Pat. No. 7,500,805 of Brochu et al. Sub-corrugations are also distinguished from ribs, which in the lexicon used here are upstanding solid or hollow fin-like members which project inwardly or outwardly from the chamber wall.

In a chamber of the present invention, a sub-corrugation is present on one or more of the crest corrugations or valley corrugations. Typically, a plurality, and most often all, crest corrugations will have sub-corrugations. Likewise, when valley sub-corrugations are present they will be present in a plurality, most often all, of valley corrugations along the length of the chamber. In the generality of the invention, sub-corrugations may be present in only some of the valley corrugations or crest corrugations.

In embodiments of the invention, a sub-corrugation runs along at least a portion of the length of an associated corrugation; and it may run along the entire length. With reference to FIG. 1 and FIG. 2, a first set of sub-corrugations 32 runs upwardly in the center of the crest corrugations 28 from the elevation of the base. The sub-corrugations 32 taper in depth and width, and approach nothingness, as they reach an elevation hp, which in some embodiments of the invention, is between one-third and half of the height h of the chamber. In some other embodiments, the crest sub-corrugations may reach a height hp which is from one-quarter to two-thirds of the chamber height h. The direction of taper of a sub-corrugations 32 corresponds in sense with the taper of the crest corrugation, i.e., they both get narrower in width as they run upwardly. Dimensions of exemplary corrugations and sub-corrugations are given in FIG. 5 and are discussed below.

As may be seen in FIG. 1 and FIG. 2, a second set of sub-corrugations 36 runs along the respective centers of valley corrugations 30. The sub-corrugations 36 taper to nothingness in depth and width as they run downwardly and approach the base flange. Each exemplary valley sub-corrugation 36 runs along virtually the whole of the arch curve length of the associated valley. The direction of taper of a valley sub-corrugations corresponds in sense with the taper of the valley corrugation, i.e., each gets narrower as it approaches the elevation of the base. The width of a crest or valley sub-corrugation may alternatively be constant along part or all of the associated corrugation.

Figure 4:
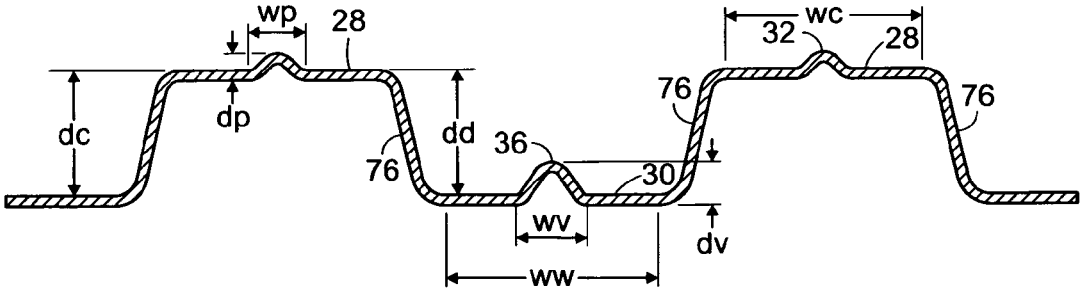
FIG. 4 is a cross section through a portion of the sidewall of the chamber shown in FIG. 1.

FIG. 4 is a cross section of a portion of the sidewall 44 chamber 20. As illustrated, crests and valleys share webs 76. Each crest corrugation 28 has a portion, running between the webs, with a width wc, and each crest sub-corrugation 32 has a width wp. The maximum dimension of wp is about one-quarter of the locally associated dimension wc. Each valley has a portion between webs with a width ww, and each valley sub-corrugation 36 has a width wv. The maximum dimension of wv is about is about one-fifth of locally associated valley dimension ww. The portion of a crest corrugation or valley corrugation which lies between the opposing side webs is sometimes referred to as the "flat" (portion) of the corrugation. Of course, in other embodiments of the invention, the corrugation cross section shape may vary. For example, the outermost part of the crest corrugation may bulge outwardly. In such instance, the portion referred to as the flat will be curved.

Again with reference to FIG. 4: Each crest corrugation has a height d which is measured relative to an adjacent valley corrugation. Each crest sub-corrugation 32 has a height dp and each valley sub-corrugation 36 has a height dv, as such are measured relative to the adjacent outer surface of the crest or valley, as applies. The maximum height dp of a crest sub-corrugation 32 is less than the locally associated height dc of the crest corrugation 28 on which it is positioned. The maximum height dv of a valley sub-corrugation 36 is less than locally associated depth dd of the valley corrugation 30 on which it is positioned. (As mentioned above, the terms height and depth are used interchangeably for the same dimension on a corrugation or sub-corrugation.)

Figures 5A, 5B, 5C, 5D, 5E, 5F:
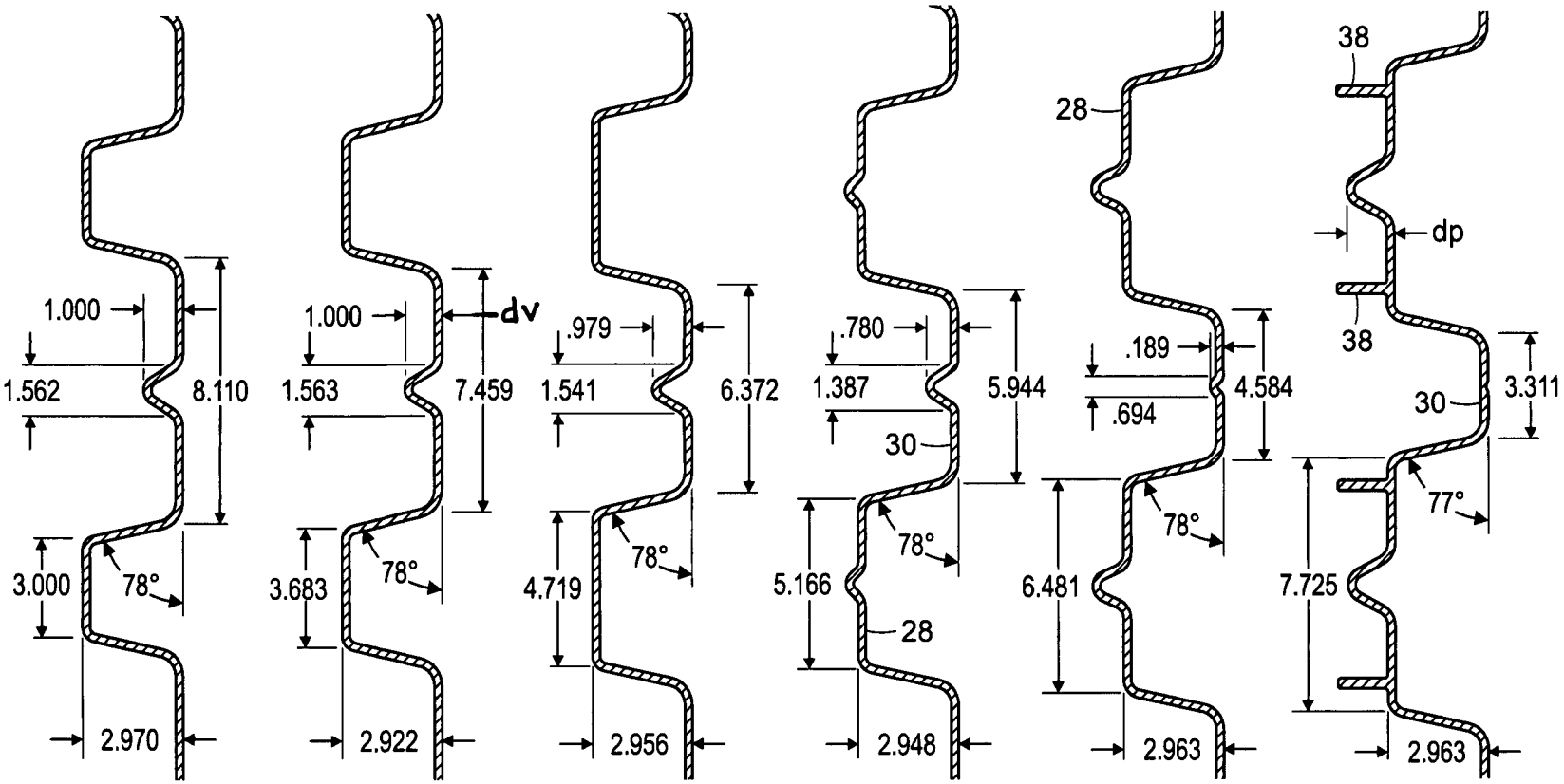
FIG. 5 comprises FIG. 5(*a*) through FIG. 5(*f*) and shows portions of sidewall cross sections at different chamber elevations, as points illustrated in FIG. 3.

The cross sections of FIG. 5(*a*) through (*f*) show how the shape of the sidewall varies, in particular the shapes of corrugations and sub-corrugations, with elevation from the base. As reference to FIG. 3 will show, the FIG. 5 cross sections are as follows: FIG. 5(*a*) is at the peak of the chamber; FIG. 5(*b*) is at about two thirds elevation, from the base; FIG. 5(*c*) is at a point just above the crest sub-corrugation terminal end; FIG. 5(*d*) is at about one third elevation (and is the same section which is pictured in FIG. 4); FIG. 5(*e*) is near the base and the point where the valley sub-corrugation is diminishing to nothingness; and FIG. 5(*f*) is just above the upper surface of the base flange and thus the cross sections of stacking lugs 38 are present.

The cross section shapes of sub-corrugations may be vary from those which are pictured here. For instance, they may be characterized by greater or lesser included angle in cross-section, or they may have flattened tops or bottoms, etc. In embodiments of the invention, the shape of the sub-corrugations are preferably chosen so that the stacking height, or vertical separation between nested chambers, is not adversely affected, compared to a chamber having the same configuration but lacking sub-corrugations.

In an injection molded chamber, the precision of the process means that wall thickness of the chamber at the location of a sub-corrugation may be made substantially the same as the thickness of the adjacent corrugation portions, as visually evident in FIG. 5. When the invention is applied to products made by thermoforming or another comparatively less precise dimension-producing process the thickness of a sub-corrugation may be somewhat thinner (or thicker) than the adjacent corrugation wall.

Despite the small increase in cross sectional area, a surprisingly large benefit in strength is realized through use of sub-corrugations, despite the sidewall weight being increased by a very modest amount. This is shown by the test data in Table 1. Short, straight polyethylene segments representative of portions of the chamber wall were subjected to compressive loading. The specimen behavior was measured to determine load bearing capacity up to the point of failure. Each segment comprised a valley with two adjacent crests.

TABLE 1

Corrugated specimen test data

| Specimen | Description | Wall area per unit width of specimen ($inch^2$/inch) | Load capacity per unit width of specimen (lb/inch) | Relative weight | Relative Strength |
|---|---|---|---|---|---|
| A | 0.25 inch thick wall | 0.255 | 240 | 1 | 1 |
| D | 0.375 inch thick wall | 0.413 | 579 | 1.62 | 2.41 |
| B | 0.25 inch thick wall with sub-corrugations | 0.258 | 349 | 1.01 | 1.45 |

With reference to the table, Specimen A represented a baseline chamber wall which was nominally 0.250 inch thick and had no sub-corrugations. Specimen D was similarly shaped but had a nominal 0.375 inch thickness. Specimen B was nominally 0.250 inch thick; it had the same shape as Specimen A, with the addition of a sub-corrugation at each of the valley corrugation and the two crest corrugations.

The first data column shows the cross sectional area per unit width of the specimen, in a plane perpendicular to the direction of the applied load. (The width of the specimen corresponds with the lengthwise direction of a chamber wall.) The weight of plastic material in the specimen is of course proportional to the cross sectional area of the specimen. The third data column gives the normalized relative weight of the specimen. The second data column shows the load capacity of the specimen; those data are normalized as relative strength, in the last data column.

As might be expected, the thicker 0.375 inch thick Specimen D has a substantially greater load bearing capacity than does the baseline specimen A. However, the weight is increased by somewhat more than 50 percent; and, the disadvantages mentioned in the Background arise—namely increased material cost, reduced injection molding manufacturability, and reduced ability for installers to manually handle.

The performance of Specimen B is surprising. The addition of sub-corrugations provides about 45 percent increase in load capacity with only about one percent increase in weight. The behavior of the specimens is qualitatively reflective of the behavior of walls in actual chambers, where the mechanics are more complex.

Specimens having the same configurations as the specimens A and B were subjected to beam flexure testing based on ASTM D 6272 Procedure B. The result was that the specimens B, with sub-corrugations, were somewhat stiffer, but were not substantially stronger at flexure failure, than were the comparable thickness specimens A, which lacked sub-corrugations.

Referring again to the chamber 20 shown in FIG. 1 through FIG. 5, it is both feasible and desirable to reduce the size of a crest sub-corrugation, as by the tapering down to nothingness, with increasing elevation. Generally, a sub-corrugation can be diminished or reduced to nothingness in chamber regions where structural analysis and or testing show that a sub-corrugation would not be of much value. Simply put, if the "flat" portion of the crest becomes become sufficiently small, so that the local buckling resistance is good, then the sub-corrugation need not be present. The same approach and rationale apply to the tapering in size and or presence of sub-corrugations in valleys. When a sub-corrugation is reduced in size, or not present, less plastic is used in making the chamber. Nonetheless, in the generality of the invention, a crest sub-corrugation, or a valley sub-corrugation, may run along the whole arch curve of a chamber.

Typically a chamber of the present invention will be made of commercial grade polyethylene or polypropylene, virgin or recycled, or some other polyolefin or combination thereof. Alternatively, the chamber may be made of any of a variety of other plastics, including fiberglass reinforced plastic, or other materials. The invention chambers are preferably made by injection molding but may be also made by rotational molding, thermoforming, by layering or lay-up (as with certain fiberglass reinforced plastics), and by other plastic molding methods.

An exemplary polypropylene chamber like chamber 20 may be about 90 inches long, about 77 inches wide at the base, about 45 inches high at the top, and will weigh about 120-130 pounds. It will have a typical wall thickness of about one-quarter inch. The depth of corrugation (i.e., the difference in elevation between a crest and adjacent valley) is about three inches. The period P of the crest corrugations is about 12 inches.

Another exemplary chamber may be about 52 inches long, about 100 inches wide at the base, about 60 inches high at the top, and will weigh about 120 to 130 pounds. It will have a typical wall thickness of about 0.25 to 0.30 inches. The depth of corrugation (difference in elevation between a crest and adjacent valley) is about 5 inches. The period P of the crest corrugations is about 15 inches.

Another exemplary chamber may be about 90 inches long, about 51 inches wide at the base, about 30 inches high at the top, and will weigh about 75 to 80 pounds. It will have a typical wall thickness of about 0.175 to 0.20 inches. The depth of corrugation (difference in elevation between a crest and adjacent valley) is about 2.5 inches. The period P of the crest corrugations is about 7 inches. The sub-corrugations are along the lines of those shown in FIG. 8, discussed below. In this chamber embodiment, the calculated load bearing capacity of the chamber is increased by about 30 percent through the use of sub-corrugations, while the weight is only increased by about one percent.

Sometimes, for providing increased strength to a chamber design, the wall thickness of a corrugated chamber will be increased somewhat in combination with adding sub-corrugations, notwithstanding the disadvantages which have been mentioned in connection with using more weight of plastic. The dimensions of the chamber corrugations, and the period of the corrugations, may vary substantially in other embodiments of the invention. The invention may be used with chamber designs known in the prior art. Exemplary chambers meet performance requirements related to the AASHTO specifications and NCHRP Report mentioned in the Background.

Figure 6:
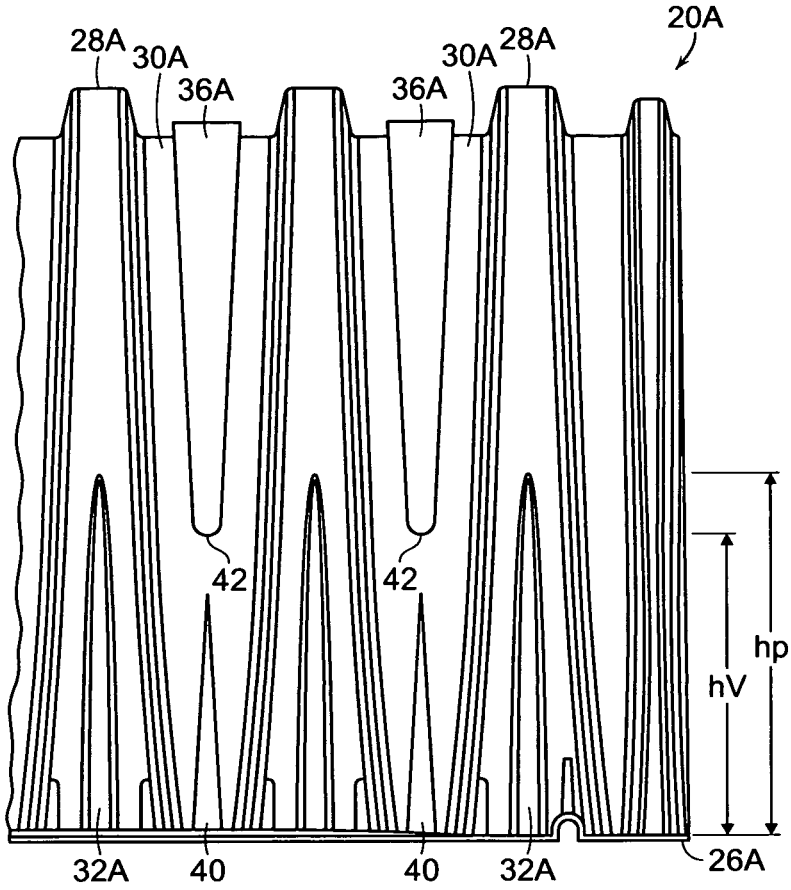
FIG. 6 is a partial side view of a chamber having three different styles of sub-corrugations.

FIG. 6 shows in chamber 20A in side elevation. The numbered features of chamber 20A, and chamber 20B, etc., correspond with those of chamber 20, with addition of the suffix. The overall shape and corrugations of exemplary chambers 20A and 20B are like those of chamber 20. In chamber 20A of FIG. 6, the sub-corrugations 32A on the crest corrugations are nominally the same as previously described. But the valley corrugations are different. Valley corrugations 36A run downwardly in the valleys to somewhat blunt-end termination points 42, which points are at an elevation hv that is lower than the elevation hp at which the upper ends of the crest corrugations 32A terminate. Thus the crest and valley sub-corrugations complement each other in strengthening the chamber. In addition, there is an optional second set of valley corrugations 40 which run upwardly from the base.

Figure 7:
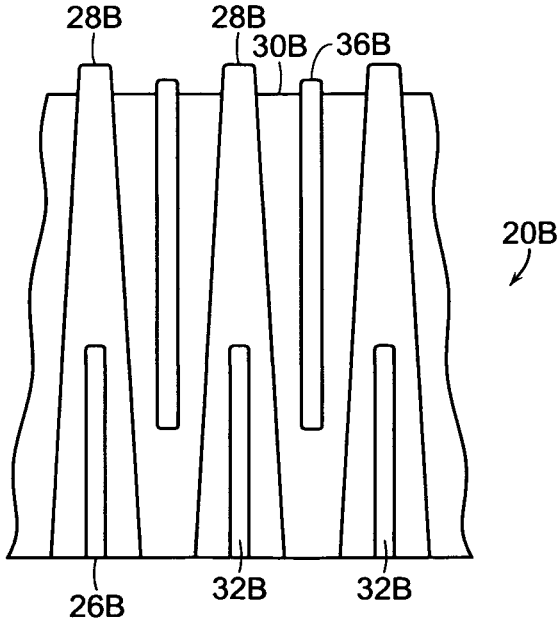
FIG. 7 is a partial side view of a chamber having sub-corrugations with terminal ends which are blunt.

FIG. 7 shows chamber 20B in side elevation. The sub-corrugations 32B and 36B have approximately constant width and approximately constant depth. Instead of tapering down to nothingness, they have blunt ends.

Figure 8:
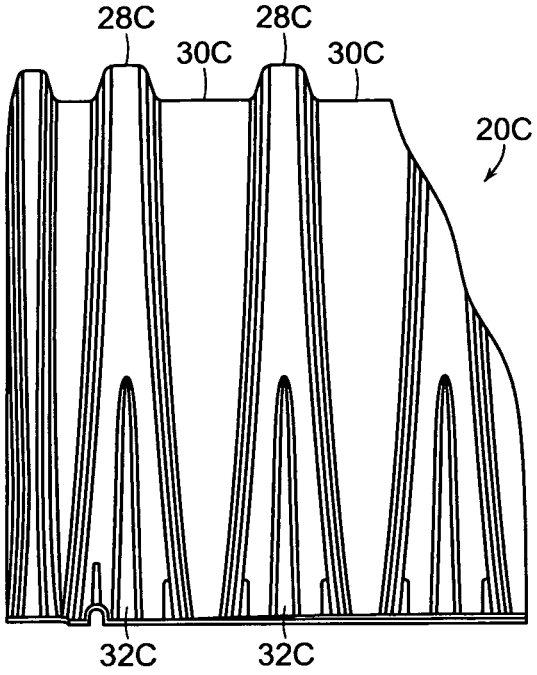
FIG. 8 is a partial side view of a chamber having sub-corrugations only on crest corrugations.

FIG. 8 is a fragmentary side view of exemplary chamber 20C which has crest corrugations 28C that have sub-corrugations 32C which taper to nothingness part way up the chamber, and valley corrugations 30C which are free of sub-corrugations.

Figure 9:
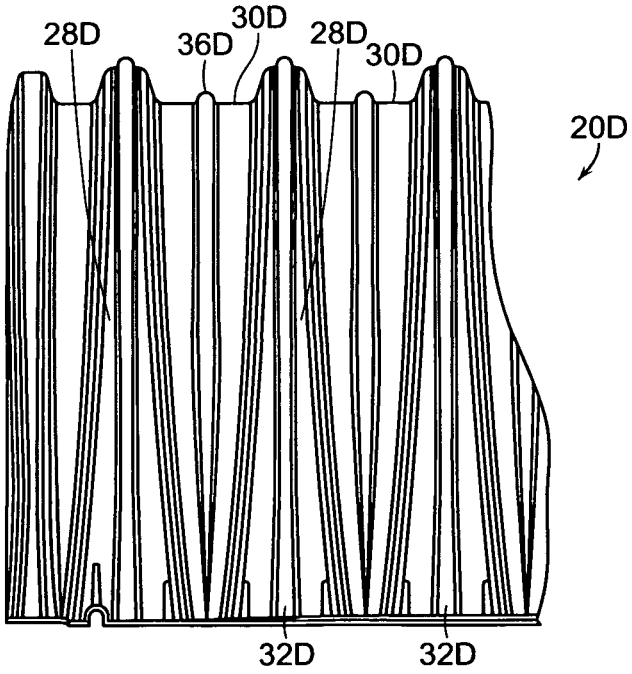
FIG. 9 is a fragmentary side view of a chamber having crest and valley sub-corrugations which run over the top of the chamber, from one base flange to the other.

FIG. 9 is a fragmentary side view of exemplary chamber 20D which has crest corrugations 28D that have sub-corrugations 32D, and valley corrugations 30C which have sub-corrugations 36D. Both of the sub-corrugations run up and over the top of the chamber and down to about the elevation of the flange on the opposing side of the chamber.

Thus, in the embodiments shown and in the invention in general, the sub-corrugations may alternately have tapered ends or blunt ends; or they may run all the way along the arch curve. Sub-corrugations which taper or diminish to nothingness, may do that by way of the height only diminishing or the width only diminishing, or both dimensions diminishing simultaneously. Sub-corrugations may alternately have taper along their lengths, or they may have constant widths. When the sub-corrugations do not go the whole length of associated valleys or crests, the elevations at which sub-corrugations terminate may be the same for all sub-corrugations; or the elevations may differ. A chamber may have a combination constant dimension sections and tapering dimension sections.

Other chamber embodiments of the invention may have sub-corrugations only in crest corrugations or only in valley corrugations. As mentioned, a chamber may have sub-corrugations in only some of the crests and or in only some of the valleys or in only some both crests and valleys.

Use of sub-corrugations compares favorably with other alternatives for obtaining better strength in a chamber, including increasing wall thickness or applying ribs to the interior or exterior. An associated benefit of sub-corrugations is that there is a small but desirable increase in interior volume of the chamber, thus increasing its capacity to store stormwater.

In use, chambers of the present invention are placed on a graded surface, and connected end to end to form a string of chambers. After suitable end caps or closures are placed at the ends of the strings, and desired piping is installed, the chambers are back-filled with soil. Sometimes chambers are set on a geotextile covered surface and sometimes they are covered in geotextile. Chambers of the present invention may have features like those associated with prior art chambers, including that they may have a multiplicity of relatively small sidewall ports, spaced apart along the sidewalls, to allow lateral water flow out of the chambers, providing strength is not unacceptably compromised by the ports.

While the invention has been presented primarily in terms of chambers for receiving stormwater, the invention will also be useful in arch shape cross section corrugated chambers which are useful for other purposes, such as receiving wastewater, or for providing arch shape cross section enclosures for creating spaces in soils and storing or protecting things.

End Caps

Typically, end caps are placed on the outermost ends of strings of interconnected chambers, to keep the surrounding medium, e.g., stone aggregate, from intruding into the interiors of the chambers. End caps which have outwardly bulging dome shape contours. Those shapes may also be referred to as presenting as compoundly concave shapes. Prior art end caps of such type are described in U.S. Pat. No. 7,237,981 of Vitarelli et al., U.S. Pat. No. 7,118,306 of Kruger et al., and U.S. Pat. No. 7,491,015 of Coppes et al., the disclosures of all of which are hereby incorporated by reference. As reference to the foregoing patents will show, typical prior art end caps have had a multiplicity of ribs on the concave interior side.

Figure 10:
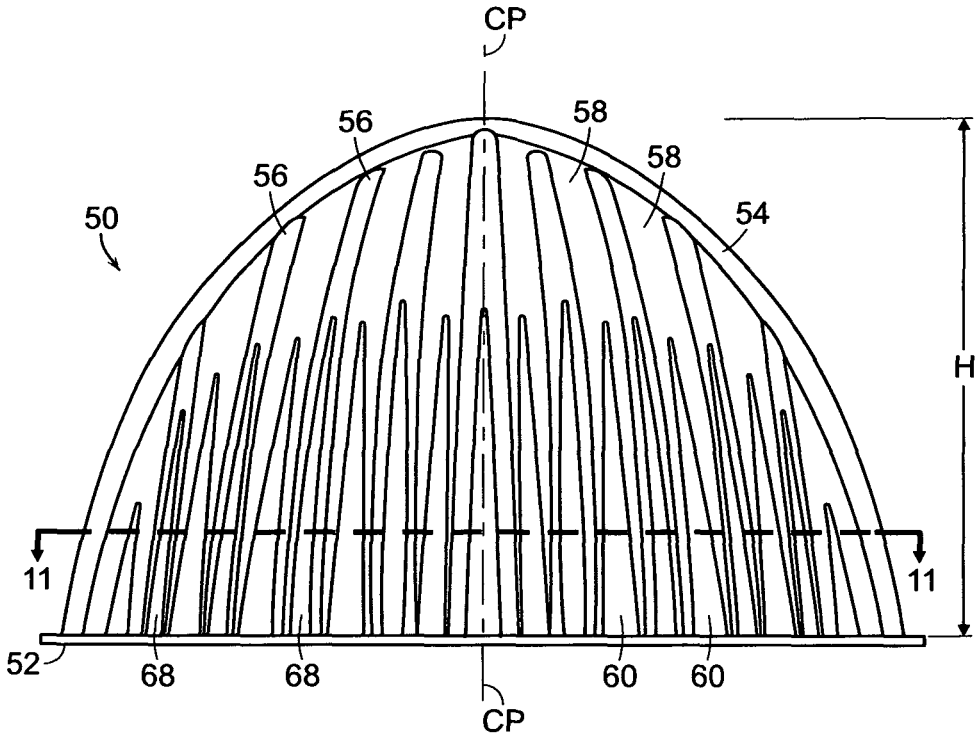
FIG. 10, is an end view of an end cap suited for closing the open end of a chamber.
Figure 11:
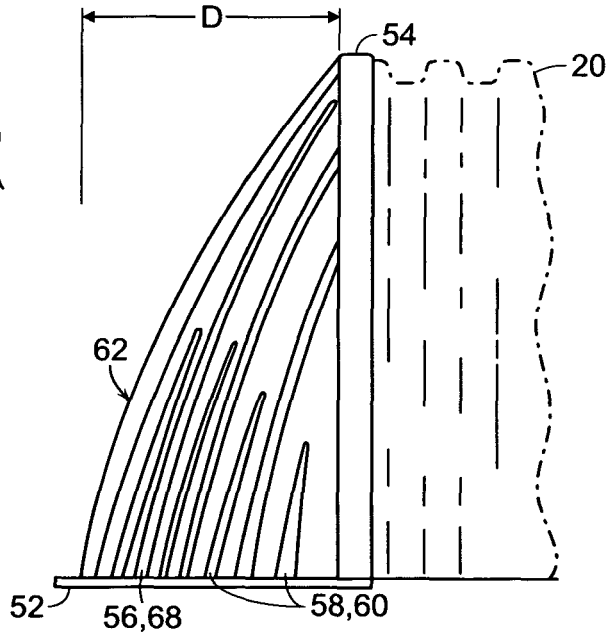
FIG. 11 is a side view of the end cap of FIG. 10.
Figure 12:
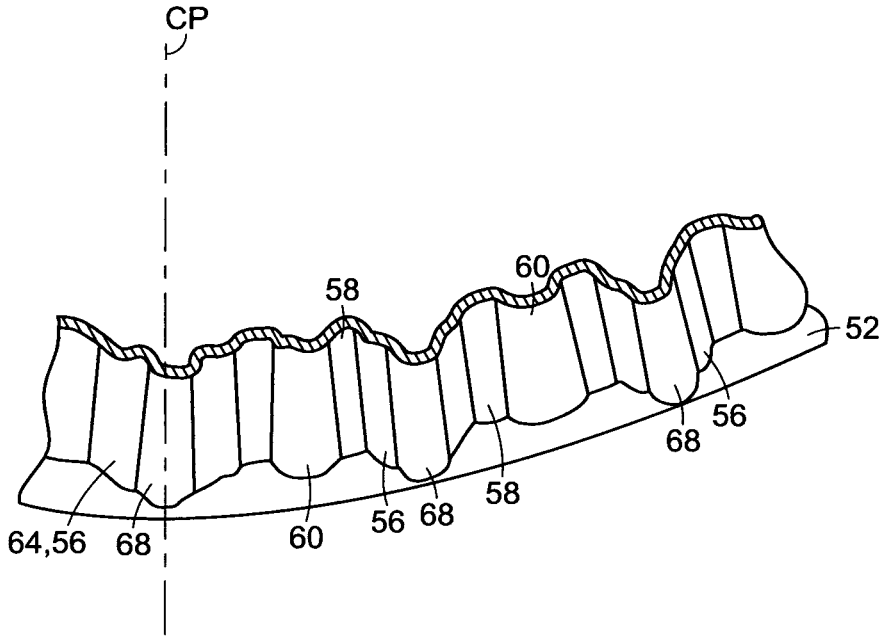
FIG. 12 is a portion of a horizontal plane cross section view of the end cap of FIG. 11.

In embodiments of the present invention, an end cap has a plurality of upward running crest corrugations and valley corrugations. In one embodiment there are sub-corrugations in the valleys and crests, and there is an absence of interior ribbing. FIG. 10 is an end view and FIG. 11 is a side view of and an exemplary end cap 50 of the present invention. In FIG. 10, the end cap is illustrated a portion of a chamber 20, shown in phantom, to indicate how it is used to close off the end of the chamber. FIG. 13 is a partial horizontal cross section view of the cap, at an elevation somewhat above the elevation of the base. The line CP in the Figures indicates the vertical axis of the cap. The cap body has a nominal maximum height H and a nominal maximum depth D, as indicated in FIG. 10 and FIG. 11.

End cap 50 an attachment end 54 which defines an arch shape opening for mating with the arch shape cross section of a chamber. Preferably, the end 54 comprises a flange as pictured, for overlapping or underlapping the end of a chamber. End cap 50 has an arch shape base 52. The base preferably comprises a flange as shown, to provide bearing area for better supporting the cap on soil. End 54 has downwardly extending terminal ends; and base 52 has horizontally extending terminal ends. The terminal ends are connected to each other at points 72.

End cap 50 comprises a compound convex shape wall 62, which connects the arc of the attachment end 54 with the arch of the base 52. In prior patents the wall may have been referred to as an outward bulging dome or a dome-shape body. End cap wall 62 is comprised of a plurality of alternating crest corrugations 56 and valley corrugations 58 which run upwardly from the base flange. The corrugations curve inwardly along the contour of wall 62. As seen in FIG. 10, the corrugations may be characterized as running substantially vertically, as may be seen when they are projected into a vertical plane which runs through the connection points 72 of the terminal ends and parallel to vertical axis CP. Within the meaning of substantially vertical, the corrugations may have a tilt or curve, for instance as appears in FIG. 10.

Sub-corrugations 60 run upwardly within each valley corrugation 58. Crest corrugations 56 have corresponding sub-corrugations 68. In the center portion of the body, the sub-corrugations run up to a maximum height of about 60 percent of the total or maximum height H of the peak of the end cap, as such heights are projected into an aforesaid vertical plane. Near the left-right outer edges, as seen in FIG. 10, the sub-corrugations run up to about 25 percent of the peak height.

The principles of the chamber inventions which involve sub-corrugations, described above, can be applied in end caps; and the foregoing disclosure with respect to chamber corrugations and sub-corrugations is hereby incorporated by reference. In brief, the corrugations provide stiffness and structural strength to the body of the end cap, and the sub-corrugations increase the strength and buckling resistance of the end cap body structure. The benefit is that a strong end cap can be made in an efficient way with less weight of material than would otherwise be required.

An embodiment of end cap comprises corrugations having a plurality of sub-corrugations, where each sub-corrugation runs upwardly from the elevation of the base on a plurality of either or both crest corrugations or valley corrugations. Each sub-corrugation has a depth less than the depth of the corrugation with which it is associated. Preferably, in an exemplary cap, each sub-corrugation diminishes in width and depth with elevation. In another exemplary end cap, each sub-corrugation terminates at an elevation which is less than the elevation of attachment end at the location of the particular corrugation with which the sub-corrugation is associated. In another embodiment exemplary cap, the sub-corrugations terminate at an elevation which is no more than about 60 percent of the overall height of the end cap.

In alternate embodiments of the cap invention, some valley corrugations and or some crest corrugations may not have sub-corrugations; or some or all of the sub-corrugations may run all the way up the respective crests or valleys, from the base to the attachment end.

End caps may be fabricated of materials and in ways which are described above for the chambers. An exemplary end cap for a large chamber may have a height of about 57 inches, a base flange width of about 98 inches, and a depth D of about 33 inches, as measured at about the elevation of the base flange. Such a chamber may be made of polyethylene or polypropylene by rotational molding, and it may have a basic wall thickness of about 0.35 inches. Rotational molding materials as a class have lower strength than comparable composition injection molding or thermoforming materials. They are also less reliable in producing uniform thickness or repeatable dimension. Thus, the use of sub-corrugations can be advantageous beyond the reasons already given. In another alternative, it may be practical to form from sheet metal an end cap of the present invention.

Although the inventions have been described and illustrated with respect to several embodiments, those embodiments should be considered illustrative and not restrictive. Any use of words, such as "preferred" and variations thereof, is intended to suggest a combination of features which is desirable but which is not necessarily mandatory; and, embodiments lacking any such preferred features or combination may be within the scope of the claims which follow. Persons skilled in the art may make various changes in form and detail without departing from the spirit and scope of the claimed invention.

What is claimed is:

1. A chamber, comprising:

opposing side bases running generally parallel to a chamber length for supporting the chamber;

a chamber top;

sidewalls running from the opposing side bases to the chamber top, wherein the sidewalls and top form an arch-curve;

a plurality of alternating crest corrugations and valley corrugations running transverse to the length of the chamber along the arch-curve of the chamber, wherein the crest corrugations decrease in width with elevation from the opposing side bases, and the valley corrugations increase in width with elevation from the opposing side bases, as width is measured in a direction parallel to the chamber length axis; and a plurality of crest sub-corrugations, each crest sub-corrugation running upwardly from an opposing side base and along a portion of the arch-curve of a crest corrugation, each crest sub-corrugation having a height less than a local height of the crest corrugation with which the crest sub-corrugation is associated, each crest sub-corrugation terminating at an elevation lower than the top of the chamber, wherein the height of each crest sub-corrugation diminishes with increasing elevation.

2. The chamber of claim 1, wherein each crest sub-corrugation has a width which diminishes with increasing elevation.

3. The chamber of claim 1, wherein the crest sub-corrugations extend about one quarter to two-thirds of a height of the chamber.

4. The chamber of claim 1, wherein a maximum width of each crest sub-corrugation is no more than one-third of a local width of the associated crest corrugation.

5. The chamber of claim 1, further comprising a plurality of valley sub-corrugations, each valley sub-corrugation running downwardly from the top of the chamber and along part or all of a valley corrugation, each valley sub-corrugation having a height less than a depth of the valley corrugation with which the valley sub-corrugation is associated, each valley sub-corrugation terminating at an elevation lower than the top of the chamber.

6. The chamber of claim 5, wherein each valley sub-corrugation terminates at an elevation above the opposing side bases.

7. The chamber of claim 6, wherein each valley sub-corrugation diminishes in both height and width in proximity to the opposing side bases, as width is measured in a direction which is parallel to the length of the chamber.

8. The chamber of claim 5, wherein each valley sub-corrugation runs downwardly from the top of the chamber and terminates at a point on each opposing side that is above each opposing side base, wherein each crest sub-corrugation runs upwardly from an opposing side base and terminates at an elevation which is higher than the termination points of the valley sub-corrugations.

9. The chamber of claim 5, wherein a maximum width of each valley sub-corrugation is no more than one-third of a local width of the associated valley corrugation, as width is measured in a direction parallel to the length of the chamber.

10. The chamber of claim 5, wherein the valley sub-corrugations have lower termination ends on the sidewalls of the chamber, wherein the crest sub-corrugations have upper termination ends on the sidewalls of the chamber, wherein the crest sub-corrugation termination ends are higher in elevation than elevations of the valley sub-corrugation terminal ends.

11. The chamber of claim 1, further comprising a first plurality of valley sub-corrugations and a second plurality of valley sub-corrugations, each of the first plurality of valley sub-corrugations running downwardly from the top of the chamber and along part or all of a valley corrugation and terminating at terminal ends above the elevation of the opposing side bases, each of the second plurality of valley sub-corrugations running within a valley corrugation upwardly from an opposing side base in the direction of said terminal ends of the first plurality of valley sub-corrugations.

12. The chamber of claim 1, further comprising a plurality of valley sub-corrugations, each valley sub-corrugation running downwardly from the top of the chamber along a valley corrugation, wherein a width of each valley sub-corrugation is constant.

13. The chamber of claim 1, further comprising a plurality of valley sub-corrugations, each valley sub-corrugation running along a valley corrugation, downwardly from the top of the chamber towards the opposing side bases, wherein a height of each valley sub-corrugation decreases as the valley sub-corrugation approaches the opposing side bases.

14. A chamber, comprising:

opposing side bases;

sidewalls running from the opposing side bases and forming an arch-curve of the chamber;

flanges associated with the opposing side bases and configured to support the chamber;

a plurality of alternating crest corrugations and valley corrugations running transverse to a length of the chamber along the arch-curve of the chamber, wherein the crest corrugations decrease in width with elevation from the opposing side bases, and the valley corrugations increase in width with elevation from the opposing side bases, as width is measured in a direction parallel to the chamber length;

a first plurality of sub-corrugations running upwardly from the opposing side bases on crest corrugations to termination points which are at an elevation less than an elevation of a top of the chamber; and a second plurality of sub-corrugations running in valley corrugations at the top of the chamber and downwardly toward the opposing side bases to an elevation which is less than the elevation of said termination points of the first plurality of sub-corrugations.

15. The chamber of claim 14, wherein a width and a depth of each sub-corrugation change along part or all of the sub-corrugation as the width of the crest corrugation or valley corrugation with which the sub-corrugation is associated changes.

16. The chamber of claim 14, wherein the elevations of the termination points of plurality of sub-corrugations are the same.

17. The chamber of claim 14, wherein a width of each of the second plurality of sub-corrugations running in a valley corrugation is constant.

18. The chamber of claim 14, wherein a height of each of the second plurality of sub-corrugations running in a valley corrugation decreases as the sub-corrugation approaches the opposing side bases.

19. A chamber, comprising:

opposing side bases running generally parallel to a chamber length for supporting the chamber;

a chamber top;

sidewalls running from the opposing side bases to the chamber top, wherein the sidewalls and top form an arch-curve;

a plurality of alternating crest corrugations and valley corrugations running transverse to the length of the chamber along the arch curve of the chamber, wherein the crest corrugations decrease in width with elevation from the opposing side bases, and the valley corrugations increase in width with elevation from the opposing side bases, as width is measured in a direction parallel to the chamber length; and a plurality of crest sub-corrugations, each sub-corrugation running upwardly from an opposing side base and along a portion of the arch-curve of a crest corrugation, each sub-corrugation having a height less than a local height of the crest corrugation with which the sub-corrugation is associated, each crest sub-corrugation terminating at an elevation lower than the top of the chamber, wherein the crest sub-corrugations extend about one quarter to two-thirds of a height of the chamber.

20. A chamber, comprising:

opposing side bases running generally parallel to a chamber length for supporting the chamber;

a chamber top;

sidewalls running from the opposing side bases to the chamber top, wherein the sidewalls and top form an arch-curve;

a plurality of alternating crest corrugations and valley corrugations running transverse to the length of the chamber along the arch curve of the chamber, wherein the crest corrugations decrease in width with elevation from the opposing side bases, and the valley corrugations increase in width with elevation from the opposing side bases, as width is measured in a direction parallel to the chamber length; and a plurality of crest sub-corrugations, each sub-corrugation running upwardly from an opposing side base and along a portion of the arch-curve of a crest corrugation, each sub-corrugation having a height less than a local height of the crest corrugation with which the sub-corrugation is associated, each crest sub-corrugation terminating at an elevation lower than the top of the chamber, wherein a maximum width of each crest sub-corrugation is no more than one-third of a local width of the associated crest corrugation.

21. A chamber, comprising:

opposing side bases running generally parallel to a chamber length for supporting the chamber;

a chamber top;

sidewalls running from the opposing side bases to the chamber top, wherein the sidewalls and top form an arch-curve;

a plurality of alternating crest corrugations and valley corrugations running transverse to the length of the chamber along the arch curve of the chamber, wherein the crest corrugations decrease in width with elevation from the opposing side bases, and the valley corrugations increase in width with elevation from the opposing side bases, as width is measured in a direction parallel to the chamber length;

a plurality of crest sub-corrugations, each crest sub-corrugation running upwardly from an opposing side base and along a portion of the arch-curve of a crest corrugation, each crest sub-corrugation having a height less than a local height of the crest corrugation with which the crest sub-corrugation is associated, each crest sub-corrugation terminating at an elevation lower than the top of the chamber; and a plurality of valley sub-corrugations, each valley sub-corrugation running downwardly from the top of the chamber and along part or all of a valley corrugation, each valley sub-corrugation having a height less than a depth of the valley corrugation with which the valley sub-corrugation is associated, each valley sub-corrugation terminating at an elevation lower than the top of the chamber.

* * * * *

UNITED STATES PATENT AND TRADEMARK OFFICE

CERTIFICATE OF CORRECTION

PATENT NO. : 8,672,583 B1
APPLICATION NO. : 12/802483
DATED : March 18, 2014
INVENTOR(S) : David J. Mailhot et al.

It is certified that error appears in the above-identified patent and that said Letters Patent is hereby corrected as shown below:

In the Claims:

Claim 1, col. 13, lines 35-36, “parallel to the chamber length axis;” should read --parallel to the chamber length;--.

Claim 16, col. 15, line 5, “termination points of plurality” should read --termination points of the first plurality--.

Signed and Sealed this
Twelfth Day of August, 2014

Michelle K. Lee

Michelle K. Lee
*Deputy Director of the United States Patent and Trademark Office*